US006648247B2

(12) United States Patent
McFarland

(10) Patent No.: US 6,648,247 B2
(45) Date of Patent: Nov. 18, 2003

(54) COMBINED FILTER AND ADJUSTER FOR A FUEL INJECTOR

(75) Inventor: Robert McFarland, Newport News, VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 09/773,934

(22) Filed: Feb. 2, 2001

(65) Prior Publication Data

US 2002/0104904 A1 Aug. 8, 2002

(51) Int. Cl.[7] ..... B05B 1/30; F02M 51/00

(52) U.S. Cl. ..... 239/585.1; 239/533.6; 239/585.2; 239/585.3; 239/585.4; 239/585.5; 239/575

(58) Field of Search ..... 239/585.1, 585.2, 239/585.3, 585.4, 585.5, 575, 533.6

(56) References Cited

U.S. PATENT DOCUMENTS

| | | | | | |
|---|---|---|---|---|---|
| 4,590,911 | A | | 5/1986 | Sciotti et al. | 123/468 |
| 5,335,863 | A | * | 8/1994 | DeGrace | 239/575 |
| 5,340,032 | A | | 8/1994 | Stegmaier et al. | 239/575 |
| 5,516,424 | A | | 5/1996 | Strohschein | 210/232 |
| 5,921,475 | A | * | 7/1999 | DeVriese et al. | 239/585.4 |
| 5,937,887 | A | | 8/1999 | Baxter et al. | 137/15 |
| 5,979,866 | A | * | 11/1999 | Baxter et al. | 239/585.1 |
| 6,328,232 | B1 | * | 12/2001 | Haltiner, Jr. et al. | 239/585.1 |
| 6,499,668 | B2 | * | 12/2002 | Dallmeyer et al. | 239/5 |
| 6,499,677 | B2 | * | 12/2002 | Dallmeyer et al. | 239/575 |
| 6,502,770 | B2 | * | 1/2003 | Dallmeyer et al. | 239/585.1 |
| 6,508,417 | B2 | * | 1/2003 | Dallmeyer et al. | 239/585.1 |
| 2002/0084358 | A1 | * | 7/2002 | Dallmeyer et al. | 239/585.1 |
| 2002/0139870 | A1 | * | 10/2002 | Dallmeyer et al. | 239/585.1 |

FOREIGN PATENT DOCUMENTS

| | | |
|---|---|---|
| DE | 197 24 075 | 12/1998 |
| EP | 0 781 917 | 7/1997 |
| EP | 1 219 815 | 7/2002 |
| EP | 1 219 820 | 7/2002 |
| WO | WO 98/05861 | 2/1998 |
| WO | WO 98/15733 | 4/1998 |
| WO | WO 99/66196 | 12/1999 |
| WO | WO 00/43666 | 7/2000 |

* cited by examiner

*Primary Examiner*—Robin O. Evans

(57) ABSTRACT

A fuel injector and a method of setting dynamic calibration for the fuel injector. The fuel injector has a body, a seat, an armature assembly, a resilient member, and a member. The resilient member biases the armature assembly toward the second position. And the member extends parallel to the longitudinal axis between a first portion and a second portion. The first portion supports the resilient member and engages the body, and the second portion has a filter. The method can be achieved, in part, by providing the member extending between the first portion and the second portion, fixing the filter to the second portion such that the filter extends toward from the first portion, moving the member along the longitudinal axis with respect to the body; and engaging the first portion with respect to the body such that the first portion supports the resilient member in a predetermined dynamic state.

15 Claims, 4 Drawing Sheets

COMBINED FILTER AND ADJUSTER FOR A FUEL INJECTOR

BACKGROUND OF THE INVENTION

This invention relates to solenoid operated fuel injectors, which are used to control the injection of fuel into an internal combustion engine.

The dynamic operating characteristics of fuel injectors, i.e., movement of a closure member within a fuel injector, are believed to be set by several factors. One of these factors is believed to be calibrating the biasing force of a resilient element acting on the closure member, i.e., tending to bias the closure member to its closed position.

It is believed that a known fuel injector uses a spring to provide the biasing force. In particular, it is believed that a first end of the spring engages an armature fixed to the closure member and a second end of the spring engages a tube that is dedicated solely to the dynamic calibration of the spring. It is believed that the spring is compressed by displacing the tube relative to the armature so as to at least partially set the dynamic calibration of the fuel injector. It is believed that the tube is subsequently staked into its position relative to the armature in order to maintain the desired calibration.

It is also believed that filtering the fluid passing through fuel injectors can minimize or even prevent contaminants from interfering with a seal between the closure member and a valve seat. It is believed that a known fuel injector includes a filter that is generally proximate to a fuel inlet of the fuel injector.

It is believed that a disadvantage of these known fuel injectors is that separate elements are used for the calibrating and the fuel filter, and these elements are handled in independent manufacturing processes. Typically, it is believed that the known fuel injectors are first dynamically calibrated using a first element, and then a separate filter element is subsequently added. The multiplicity of elements and manufacturing steps is costly, both in terms of money and time.

It is believed that there is a need to reduce the cost of manufacturing a fuel injector by eliminating the number of components and combining assembly operations.

SUMMARY OF THE INVENTION

The present invention provides a fuel injector for controlling fuel flow to an internal combustion engine. The fuel injector comprises a body, a seat, an armature assembly, a resilient member, and a member. The body extends along a longitudinal axis. The seat is secured to the body and defines an opening through which fuel flows. The armature assembly moves along the longitudinal axis with respect to the body between first and second positions. The first position is spaced from the seat such that fuel flow through the opening is permitted, and the second position contiguously engages the seat such that fuel flow is prevented. The resilient member biases the armature assembly toward the second position. And the member extends parallel to the longitudinal axis between a first portion and a second portion. The first portion supports the resilient member and engages the body, and the second portion has a filter extending toward the first portion.

The present invention further provides a method of setting dynamic calibration for a fuel injector. The fuel injector has a body extending along a longitudinal axis, a seat secured to the body, an armature assembly moving along the longitudinal axis with respect to the seat, and a resilient member biasing the armature assembly toward the seat. The method comprises providing a member extending between a first portion and a second portion, fixing a filter to the second portion such that the filter extends toward the first portion, moving the member along the longitudinal axis with respect to the body; and engaging the first portion with respect to the body such that the first portion supports the resilient member in a predetermined dynamic state.

BRIEF DESCRIPTION OF THE DRAWINGS

The accompanying drawings, which are incorporated herein and constitute part of this specification, illustrate an embodiment of the invention, and, together with the general description given above and the detailed description given below, serve to explain features of the invention.

DETAILED DESCRIPTION OF THE PREFERRED EMBODIMENTS

Figure 1:
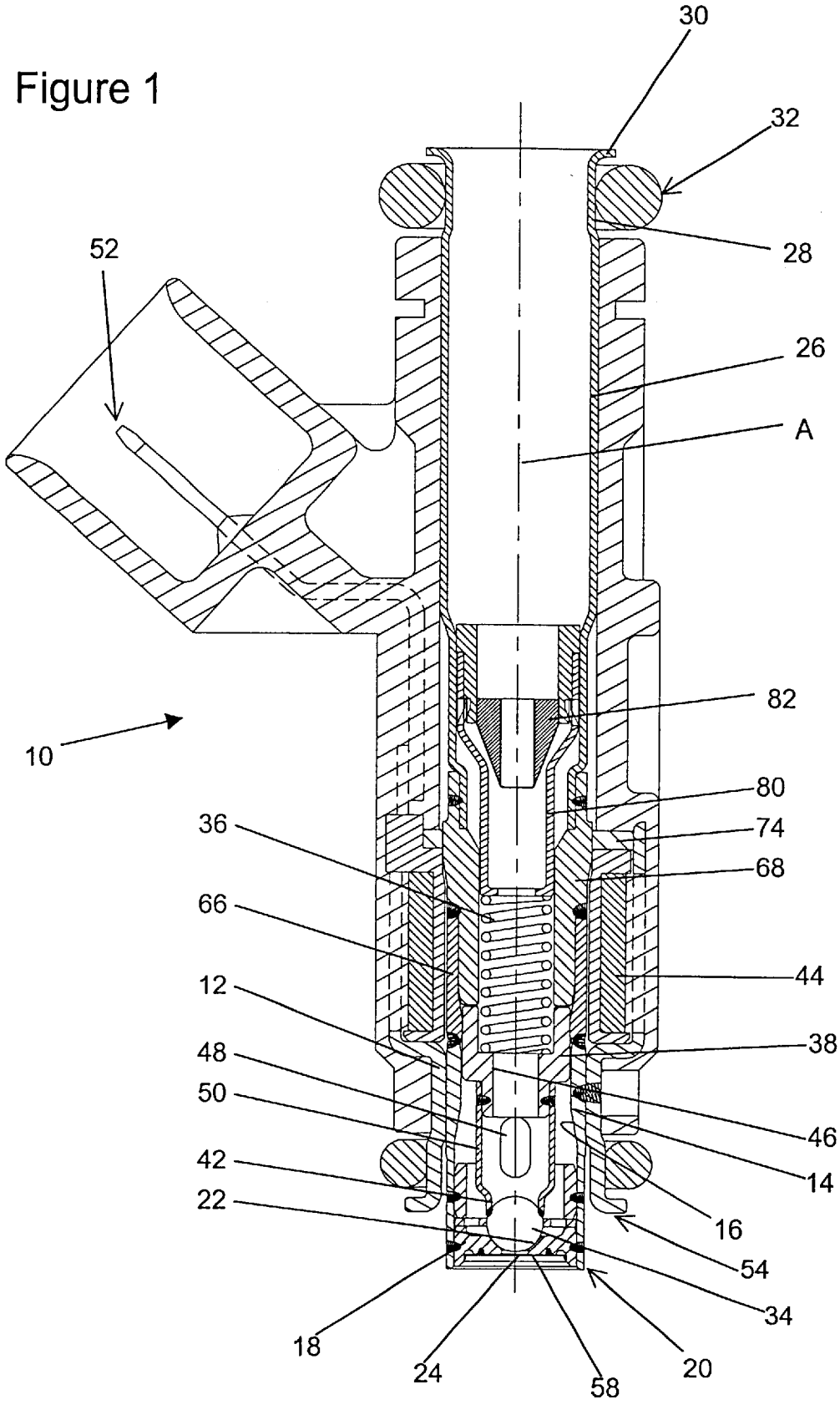
FIG. 1 is a cross-sectional view of a fuel injector assembly including a first preferred embodiment of an adjuster member with an integral filter.
Figure 2:
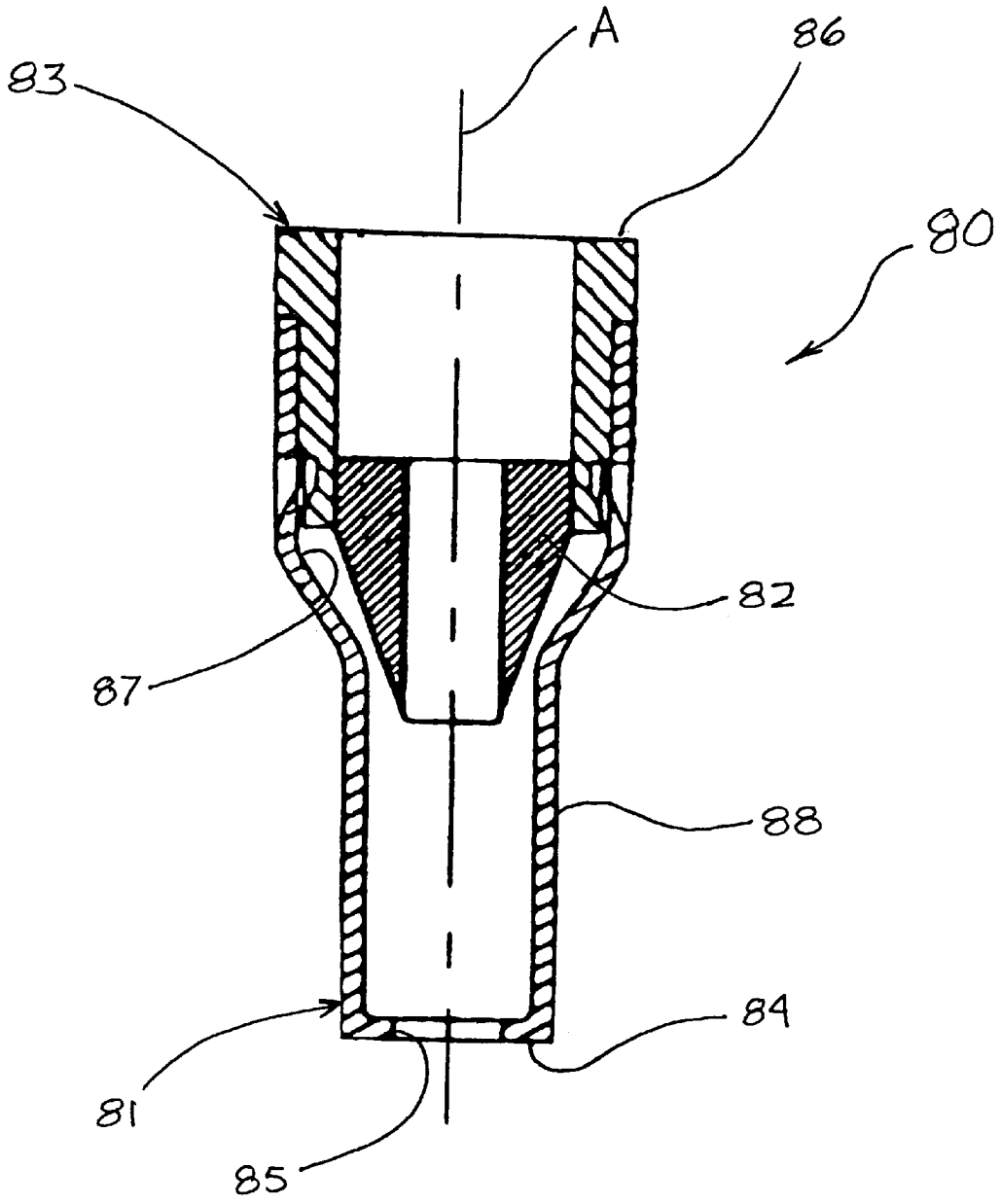
FIG. 2 is an enlarged cross-sectional view of the adjuster member shown in FIG. 1.

Referring initially to FIGS. 1 and 2, a solenoid actuated fuel injector 10, which can be of the so-called top feed type, supplies fuel to an internal combustion engine (not shown). The fuel injector 10 includes a housing 12 that extends along a longitudinal axis A and a valve body 14 fixed to the housing 12. The valve body 14 has a cylindrical sidewall 16 that is coaxial with and confronts a longitudinal axis A of the housing 12 and the valve body 14.

A valve seat 18 at one end 20 of the valve body 14 includes a seating surface 22 that can have a frustoconical or concave shape facing the interior of the valve body 14. The seating surface 22 includes a fuel outlet opening 24 that is centered on the axis A and is in fluid communication with a fuel tube 26 that receives pressurized fuel into the fuel injector 10. Fuel tube 26 includes a mounting end 28 having a retainer 30 for maintaining an O-ring 32, which is used to seal the mounting end 28 to a fuel rail (not shown).

A closure member, e.g., a spherical valve ball 34, is moveable between a closed position, as shown in FIG. 2, and an open position (not shown). In the closed position, the ball 34 is urged against the seating surface 22 to close the outlet opening 24 against fuel flow. In the open position, the ball 34 is spaced from the seating surface 22 to allow fuel flow through the outlet opening 24. An armature 38 that is axially moveable in the valve body 14 can be fixed to the valve ball 34 at an end 42 proximate the seating surface 22. A resilient member 36 can engage the armature 38 for biasing the valve ball 34 toward the closed position.

A solenoid coil 44 is operable to draw the armature 38 away from the seating surface 22, thereby moving the valve ball 34 to the open position and allowing fuel to pass through the fuel outlet opening 24. De-energizing the solenoid coil 44 allows the resilient biasing member 36 to return the valve ball 34 to the closed position, thereby closing the outlet opening 24 against the passage of fuel.

The armature 38 includes an axially extending through-bore 46 providing a passage in fluid communication with the fuel tube 26. Through-bore 46 can also receive and center the valve ball 34. A fuel passage 48 extends from the through-bore 46 to an outer surface 50 of the armature 38 that is juxtaposed to the seating surface 22, allowing fuel to be communicated through the armature 38 to the valve ball 34.

With further reference to FIG. 1, an electrical connector 52 is provided for connecting the fuel injector 10 to an electrical power supply (not shown) in order to energize the armature 38. The fuel injector 10 includes a mounting end 54 for mounting the injector 10 in an intake manifold (not shown). An O-ring 56 can be used to seal the mounting end 54 in the intake manifold. An orifice disk 58 may be provided proximate the outlet opening 24 for controlling the fuel communicated through the outlet opening 24. The orifice disk 58 can be directly welded to the valve seat 18, or a back-up washer 60, which is fixed to the valve body 14, can be used to press the orifice disk 58 against the valve seat 18.

The injector 10 maybe made of two subassemblies that are separately assembled, then fastened together to form the injector 10. Accordingly, the injector 10 includes a valve group subassembly and a coil subassembly as hereinafter more fully described.

The valve group subassembly is constructed as follows. The valve seat 18 is loaded into the valve body 14, held in a desired position, and connected, e.g., by laser welding. Separately, the valve ball 34 is connected, e.g., by laser welding, to the armature 38. The armature 38 and valve ball 34 are then loaded into the valve body 14 including the valve seat 18.

A non-magnetic sleeve 66 is pressed onto one end of a pole piece 68, and the non-magnetic sleeve 66 and the pole piece 68 are welded together. The pole piece 68 is shown as an independent element that is connected, e.g., by laser welding, to the fuel tube 26. Alternatively, the lower end of the fuel tube 26 can define the pole piece 68, i.e., the pole piece 68 and fuel tube 26 can be formed as a single, homogenous body. The non-magnetic sleeve 66 is then pressed onto the valve body 14, and the non-magnetic sleeve 66 and valve body 14 are welded together to complete the assembly of the valve group subassembly. The welds can be formed by a variety of techniques including laser welding, induction welding, spin welding, and resistance welding.

The coil group subassembly is constructed as follows. A plastic bobbin 72 is molded with straight terminals. Wire for the coil 44 is wound around the plastic bobbin 72 and this bobbin assembly is placed into a metal can, which defines the housing 12. A metal plate that defines the housing cover 74 is pressed onto the housing 12. The terminals can then be bent to their proper arrangement, and an over-mold 76 covering the housing 12 and coil 44 can be formed to complete the assembly of the coil group subassembly.

Referring to FIG. 2, an adjuster 80 has a first portion 81, which is adapted to be staked to the pole piece 68, and a second portion 83 to which a filter 82 is connected. A circumferentially inner surface 87 of the adjuster 80 sealingly engages the filter 82, and a circumferentially outer surface 88 of the adjuster 80 contiguously engages the pole piece 68. The adjuster 80, which can be a metal tube, defines an annular recess that can receive a projection from the filter 82, which can include a molded plastic housing. According to a preferred embodiment, the first portion 81 contiguously engages the pole piece 68 and is held with respect thereto by a mechanical interlock such as a friction fit, adhesive, crimping or any other equivalent means. The outer surface 88 can additionally sealingly engage the fuel tube 26. The first portion 81 of the adjuster 80 also includes a generally axially facing surface 84 that supports, e.g., directly contacts, the resilient biasing member 36. The surface 84 can include a hole 85 through which fuel can pass after passing through the filter 82. The filter 82 extends along the longitudinal axis A toward the first portion 81 and comprises an interior surface generally confronting the longitudinal axis A and an exterior surface generally oppositely facing from the interior surface. The filter 82 has a surface 86 that is adapted to be engaged by a pressing tool (not shown) for positioning the adjuster 80 with respect to the pole piece 68, and thereby compressing the spring 36 for the purpose of dynamically calibrating the fuel injector 10. The filter 82, which can be made of metal or plastic mesh or any other known equivalent material, can be attached to the inner surface 87 before the adjuster 80 is inserted into the pole piece 68. The adjuster 80 is subsequently fixed, e.g., staked, at the desired position with respect to the pole piece 68.

The coil group subassembly is axially pressed over the valve group subassembly, and the two subassemblies can then be fastened together. Fastening can be by interference fits between the housing 12 and the valve body 14, between the fuel tube 26 and the housing cover 74, or between the fuel tube 26 and the over-mold 76. Welding can also be used for fastening, e.g., the housing 12 and the valve body 14 can also be welded together. The resilient biasing member 36 and adjuster 80 are loaded through the fuel tube 26 and the injector 10 is dynamically calibrated by adjusting the relative axial position of the adjuster 80, including integral filter 82, with respect to the pole piece 68. The adjuster 80, including integral filter 82, is then fixed in place with respect to the pole piece 68.

Figure 3:
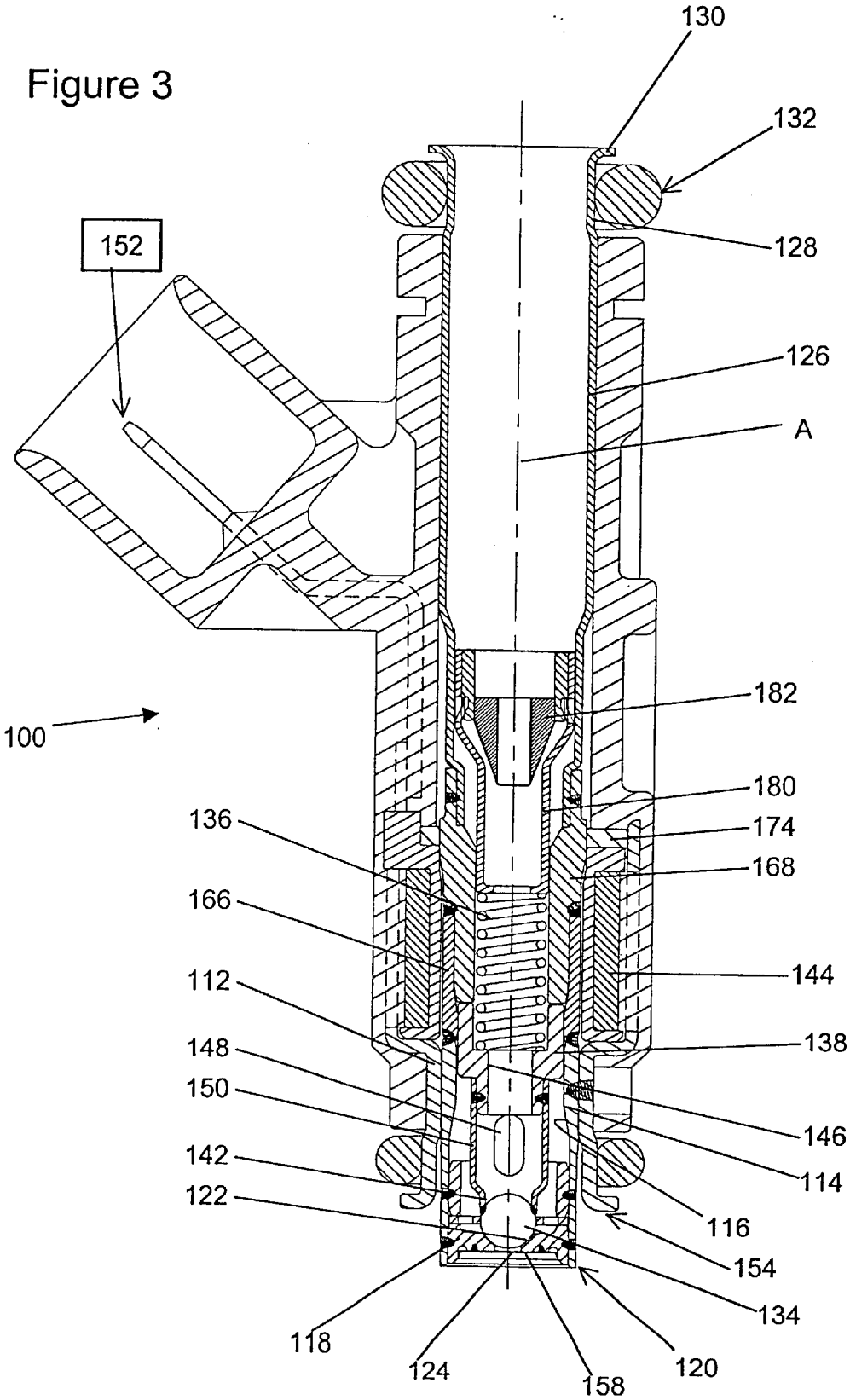
FIG. 3 is a cross-sectional view of a fuel injector assembly including a second preferred embodiment of an adjuster member with an integral filter.
Figure 4:
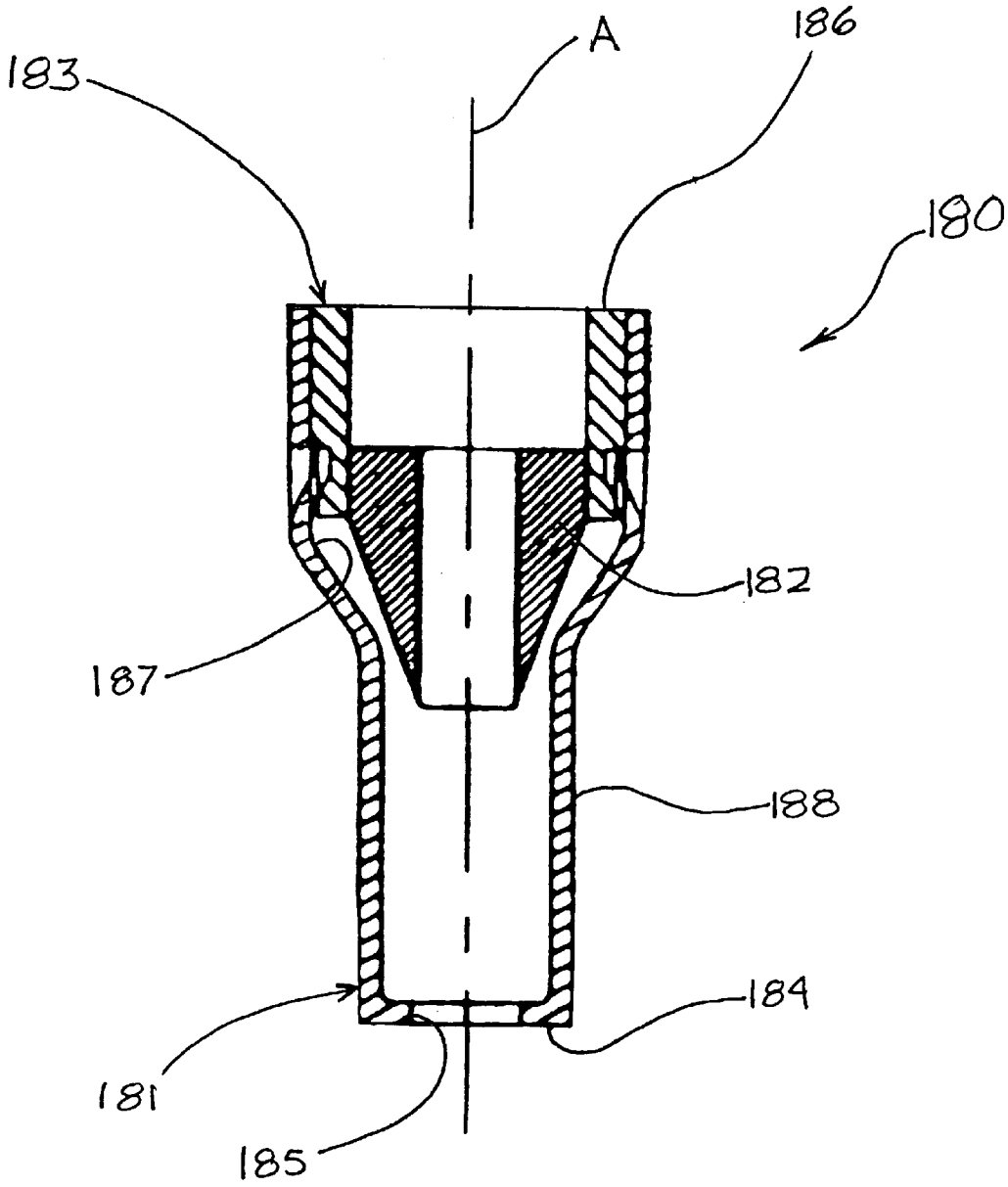
FIG. 4 is an enlarged cross-sectional view of the adjuster member shown in FIG. 3.

Referring now to FIGS. 3 and 4, which depict a second preferred embodiment, a solenoid actuated fuel injector 110, which can be of the so-called top feed type, supplies fuel to an internal combustion engine (not shown). The fuel injector 110 includes a housing 112 that extends along a longitudinal axis A and a valve body 114 fixed to the housing 112. The valve body 114 has a cylindrical sidewall 116 that is coaxial with and confronts a longitudinal axis A of the housing 112 and the valve body 114.

A valve seat 118 at one end 120 of the valve body 114 includes a seating surface 122 that can have a frustoconical or concave shape facing the interior of the valve body 114. The seating surface 122 includes a fuel outlet opening 124 that is centered on the axis A and is in fluid communication with a fuel tube 126 that receives pressurized fuel into the fuel injector 110. Fuel tube 126 includes a mounting end 128 having a retainer 130 for maintaining an O-ring 132, which is used to seal the mounting end 128 to a fuel rail (not shown).

A closure member, e.g., a spherical valve ball 134, is moveable between a closed position, as shown in FIG. 4, and an open position (not shown). In the closed position, the ball 134 is urged against the seating surface 122 to close the outlet opening 124 against fuel flow. In the open position, the ball 134 is spaced from the seating surface 122 to allow fuel flow through the outlet opening 124. An armature 138 that is axially moveable in the valve body 114 can be fixed to the valve ball 134 at an end 142 proximate the seating surface 122. A resilient member 136 can engage the armature 138 for biasing the valve ball 134 toward the closed position.

A solenoid coil 144 is operable to draw the armature 138 away from the seating surface 122, thereby moving the valve ball 134 to the open position and allowing fuel to pass through the fuel outlet opening 124. De-energizing the solenoid coil 144 allows the resilient biasing member 136 to return the valve ball 134 to the closed position, thereby closing the outlet opening 124 against the passage of fuel.

The armature 138 includes an axially extending through-bore 146 providing a passage in fluid communication with the fuel tube 126. Through-bore 146 can also receive and center the valve ball 134. A fuel passage 148 extends from the through-bore 146 to an outer surface 150 of the armature 138 that is juxtaposed to the seating surface 122, allowing fuel to be communicated through the armature 138 to the valve ball 134.

With further reference to FIG. 3, an electrical connector 152 is provided for connecting the fuel injector 110 to an electrical power supply (not shown) in order to energize the armature 138. The fuel injector 110 includes a mounting end 154 for mounting the injector 110 in an intake manifold (not shown). An O-ring 156 can be used to seal the mounting end 154 in the intake manifold. An orifice disk 158 may be provided proximate the outlet opening 124 for controlling the fuel communicated through the outlet opening 124. The orifice disk 158 can be directly welded to the valve seat 118, or a back-up washer (not shown), which is fixed to the valve body 114, can be used to press the orifice disk 158 against the valve seat 118.

The injector 110 maybe made of two subassemblies that are separately assembled, then fastened together to form the injector 110. Accordingly, the injector 110 includes a valve group subassembly and a coil subassembly as hereinafter more fully described.

The valve group subassembly is constructed as follows. The valve seat 118 is loaded into the valve body 114, held in a desired position, and connected, e.g., by laser welding. Separately, the valve ball 134 is connected, e.g., by laser welding, to the armature 138. The armature 138 and valve ball 134 are then loaded into the valve body 114 including the valve seat 118.

A non-magnetic sleeve 166 is pressed onto one end of a pole piece 168, and the non-magnetic sleeve 166 and the pole piece 168 are welded together. The pole piece 168 is shown as an independent element that is connected, e.g., by laser welding, to the fuel tube 126. Alternatively, the lower end of the fuel tube 126 can define the pole piece 168, i.e., the pole piece 168 and fuel tube 126 can be formed as a single, homogenous body. The non-magnetic sleeve 166 is then pressed onto the valve body 114, and the non-magnetic sleeve 166 and valve body 114 are welded together to complete the assembly of the valve group subassembly. The welds can be formed by a variety of techniques including laser welding, induction welding, spin welding, and resistance welding.

The coil group subassembly is constructed as follows. A plastic bobbin 172 is molded with straight terminals. Wire for the coil 144 is wound around the plastic bobbin 172 and this bobbin assembly is placed into a metal can, which defines the housing 112. A metal plate that defines the housing cover 174 is pressed onto the housing 112. The terminals can then be bent to their proper arrangement, and an over-mold 176 covering the housing 112 and coil 144 can be formed to complete the assembly of the coil group subassembly.

Referring to FIG. 4, an adjuster 180 has a first portion 181, which is adapted to be staked to the pole piece 168, and a second portion 183 to which a filter 182 is connected. A circumferentially inner surface 187 of the adjuster 180 sealingly engages the filter 182, and a circumferentially outer surface 188 of the adjuster 180 contiguously engages the pole piece 168. According to a preferred embodiment, the first portion 181 contiguously engages the pole piece 168 and is held with respect thereto by a mechanical interlock such as a friction fit, adhesive, crimping or any other equivalent means. The outer surface 188 can additionally sealingly engage the fuel tube 126. The first portion 181 of the adjuster 180 also includes a surface 184 that contiguously engages the resilient biasing member 136, and includes a hole 185 through which fuel can pass after passing through the filter 182. The filter 182 extends along the longitudinal axis A toward the first portion 181 and comprises an interior surface generally confronting the longitudinal axis A and an exterior surface generally oppositely facing from the interior surface. The filter 182 has a surface 186 that is adapted to be flush with the second portion 183 such that both the surface 186 and the second portion 183 can be engaged by a pressing tool (not shown) for positioning the adjuster 180 with respect to the pole piece 168, and thereby compressing the spring 136 for the purpose of dynamically calibrating the fuel injector 110. The filter 182, which can be made of metal or plastic mesh or any other known equivalent material, can be attached to the inner surface 187 before the adjuster 180 is inserted into the pole piece 168. The adjuster 180 is subsequently fixed, e.g., staked, at the desired position with respect to the pole piece 168.

The coil group subassembly is axially pressed over the valve group subassembly, and the two subassemblies can then be fastened together. Fastening can be by interference fits between the housing 112 and the valve body 114, between the fuel tube 126 and the housing cover 174, or between the fuel tube 126 and the over-mold 176. Welding can also be used for fastening, e.g., the housing 112 and the valve body 114 can also be welded together. The resilient biasing member 136 and adjusting tube 180 are loaded through the fuel tube 126 and the injector 110 is dynamically calibrated by adjusting the relative axial position of the adjusting tube 180, including integral filter 182, with respect to the pole piece 168. The adjuster 180, including integral filter 182, is then fixed in place with respect to the pole piece 168.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it have the full scope defined by the language of the following claims, and equivalents thereof.

What is claimed is:

1. A fuel injector for controlling fuel flow to an internal combustion engine, the fuel injector comprising:

a body extending along a longitudinal axis;

a fuel tube coupled to the body;

a seat secured to the body, the seat defining an opening through which fuel flows;

an armature assembly movable along the longitudinal axis with respect to the body, the armature assembly being movable between a first position spaced from the seat such that fuel flow through the opening is permitted and a second position contiguously engaging the seat such that fuel flow is prevented;

a pole piece coupled to the fuel tube so as to confront the armature assembly;

a resilient member biasing the armature assembly toward the second position;

a member extending parallel to the longitudinal axis between a first portion and a second portion, the first portion having a terminal end friction fitted to the pole piece and located entirely within the pole piece, the first portion supporting the resilient member, and the second portion having a filter including a conical filtering portion, the filter extending toward the first portion.

2. The fuel injector as claimed in claim 1, wherein the member comprises a surface that is pressed to move the member with respect to the body.

3. The fuel injector as claimed in claim 2, wherein the first portion comprises a tube and the surface is an annular end face of the tube.

4. The fuel injector as claimed in claim 2, wherein the second portion comprises an annular body and the surface is an annular end face of the body.

5. The fuel injector as claimed in claim 1, wherein the first portion comprises an aperture through which fuel flow passes.

6. The fuel injector as claimed in claim 1, wherein the filter extends along the longitudinal axis and comprises an interior surface generally confronting the longitudinal axis and an exterior surface generally oppositely facing from the interior surface.

7. The fuel injector as claimed in claim 6, wherein the flow passes through the filter from the interior surface to the exterior surface.

8. The fuel injector as claimed in claim 1, wherein the second portion comprises a fuel tight seal with respect to the body.

9. The fuel injector as claimed in claim 1, wherein the first portion comprises a metal tube and the second portion comprises a plastic housing at least partially received in the metal tube.

10. The fuel injector as claimed in claim 9, wherein the metal tube comprises at least one projection retaining the plastic housing.

11. A method of setting dynamic calibration for a fuel injector, the fuel injector having a body extending along a longitudinal axis, a fuel tube coupled to the body, a seat secured to the body, an armature assembly moving along the longitudinal axis with respect to the seat, a pole piece coupled to the fuel tube, and a resilient member biasing the armature assembly toward the seat, the method comprising:

providing a member extending between a first portion and a second portion, the first portion having a terminal end;

fixing a filter having a conical filtering portion to the second portion such that the filter extends toward from the first portion;

moving the member along the longitudinal axis with respect to the body; and frictionally fitting the first portion to the pole piece such that the terminal end of the first portion is located entirely within the pole piece and supports the resilient member in a predetermined dynamic state.

12. The method as claimed in claim 11, wherein the moving comprises pressing on the first portion.

13. The method as claimed in claim 11, wherein the moving comprises pressing on the second portion.

14. The method as claimed in claim 11, wherein the engaging comprises providing an interference fit between the first portion and the pole piece.

15. The method as claimed in claim 11, wherein the engaging comprises sealing the first portion with respect to the pole piece.

* * * * *